United States Patent [19]

Howard

[11] Patent Number: 4,534,582

[45] Date of Patent: Aug. 13, 1985

[54] ADHESIVE LABELS

[75] Inventor: Robin G. Howard, Bury St. Edmunds, England

[73] Assignee: Denny Bros. Printing, Suffolk, England

[21] Appl. No.: 489,359

[22] Filed: Apr. 28, 1983

[30] Foreign Application Priority Data

Apr. 28, 1982 [GB] United Kingdom ..... 8212349

[51] Int. Cl.[3] ..... G09F 3/00; B42D 1/00

[52] U.S. Cl. ..... 283/81; 283/103; 283/105; 281/14; 281/18; 281/34; 229/84; 206/610; 40/306; 40/310; 40/312

[58] Field of Search ..... 229/73, 84; 206/610; 281/14, 18, 34, 35, 37; 40/306, 310, 312; 283/79, 81, 103, 105, 106

[56] References Cited

U.S. PATENT DOCUMENTS

| | | | |
|---|---|---|---|
| 1,273,105 | 7/1918 | Van Dyke et al. | 283/81 X |
| 1,371,269 | 3/1921 | Stevens | 281/18 |
| 1,434,765 | 11/1922 | Ashby . | |
| 1,864,526 | 6/1932 | Brown . | |
| 2,706,865 | 4/1955 | Miller . | |
| 3,635,392 | 1/1972 | Burgher | 229/84 X |
| 4,288,028 | 9/1981 | Diaz | 229/73 |
| 4,308,987 | 1/1982 | Solomon | 229/73 |
| 4,323,608 | 4/1982 | Denny et al. | 40/306 X |

FOREIGN PATENT DOCUMENTS

| | | | |
|---|---|---|---|
| 0043179 | 6/1982 | European Pat. Off. . | |
| 2205240 | 5/1974 | France . | |
| 323559 | 9/1957 | Switzerland . | |
| 0024879 | 4/1895 | United Kingdom | 229/84 |

*Primary Examiner*—Paul A. Bell
*Assistant Examiner*—Taylor J. Ross
*Attorney, Agent, or Firm*—Wenderoth, Lind & Ponack

[57] ABSTRACT

An adhesive label for a container includes an instruction pamphlet 10 enclosed in a cover 11 adhesively secured by its rear face to the front face of a backing sheet 12, the rear face of which is coated with a pressure sensitive adhesive and carries a removable protective sheet. The cover 11 includes a first flap 19 which initially overlies a second flap 20 and which has its end edge glued by adhesive 25 to the backing sheet 12. Two lines 26, 27 of perforations adjacent the line of adhesive 25 define between them a strip which can be torn out to provide access to the pamphlet 10. The pamphlet 10 can subsequently be re-enclosed by inserting a tongue 24 on the second flap 20 into a slit 30 in the first flap 19.

6 Claims, 4 Drawing Figures

ADHESIVE LABELS

BACKGROUND OF THE INVENTION

This invention relates to labels and is more particularly concerned with labels intended to be adhesively secured to bottles, packets and other containers.

SUMMARY OF THE INVENTION

According to this invention in one aspect, there is provided an adhesive label comprising a sheet having a central portion which has an adhesive on its rear face and first and second flaps connected along fold lines to mutually opposite edges respectively of the central portion and extending towards each other and into overlapping relation, said flaps enclosing a leaflet or pamphlet anchored to said central portion, said first flap being overlapped by said second flap and having a tongue at its free edge, said second flap extending beyond the tongue and having on the rear face of its free edge portion a line of adhesive for fastening said portion down, said second flap also having a line of weakening adjacent said edge portion whereby the main part of the second flap can be separated from said edge portion to provide access to the leaflet or pamphlet, and said main part having a slit therein for receiving the tongue on the first flap to re-enclose the leaflet or pamphlet.

In another aspect the invention provides an adhesive label comprising a backing sheet having an adhesive on its rear face, and first and second flaps adhered to the front face of the backing sheet which flaps are spaced apart and extend towards each other and into overlapping relation enclosing between the flaps and the backing sheet a leaflet or pamphlet which is anchored with respect to the backing sheet, said first flap being overlapped by the second flap and having a tongue at its free edge, said second flap extending beyond the tongue and having its edge portion adhesively fastened down, and having a line of weakening adjacent said edge portion whereby the main part of said second flap can be separated from said edge portion to enable access to be had to the leaflet or pamphlet, and said main part of the flap having therein a slit for receiving the tongue on the first flap to reenclose the leaflet or pamphlet.

BRIEF DESCRIPTION OF THE DRAWINGS

One embodiment of the invention will now be described by way of example with reference to the accompanying drawings in which.

DETAILED DESCRIPTION OF THE PREFERRED EMBODIMENTS

Figure 1:
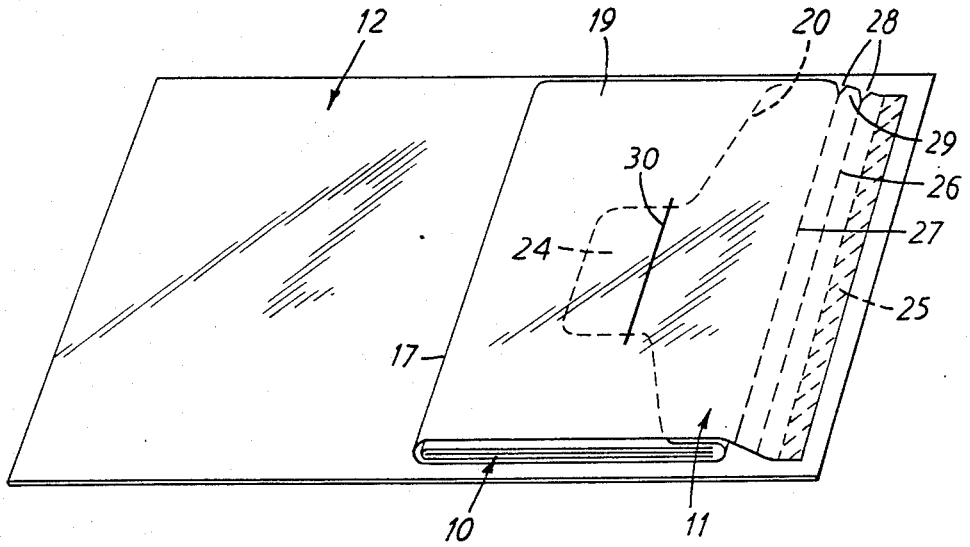
FIG. 1 shows a perspective view of a label according to the invention.
Figure 2:
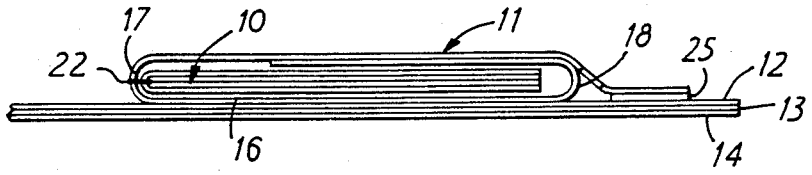
FIG. 2 shows diagrammatically, and not to scale, a local plan view of the right hand end portion of the label shown in FIG. 1.

Referring to FIGS. 1 and 2, a label is shown which is designed to be adhesively secured to a bottle or other container by automatic machinery currently in commercial use. The label includes a small pamphlet 10 of instructions for use of the contents of the bottle or other container, a cover 11 for the pamphlet 10, and a backing sheet 12 by which the pamphlet 10 and cover 11 are carried. The backing sheet 12 has on its rear face a coating 13 of a pressure-sensitive adhesive and a removable protective sheet 14 for the adhesive.

The cover 11 is made from paper and comprises a central portion 16 the rear face of which is adhesively secured to the front face of the backing sheet 12, and has connected to it along fold lines 17, 18 at opposite edges thereof two flaps 19, 20. The pamphlet 10 is in this instance in a form comprising a plurality of sheets superimposed, folded in half and secured or stapled together along the fold by one or more staples 22. The staple or staples also serve to secure the pamphlet 10 to the cover 11 along its fold line 17. The flap 20 is shorter than flap 19 and its free end is in the form of a tongue 24. Flap 19 initially overlies flap 20 and extends beyond the fold line 18, and the underside of its end edge portion carries a strip of adhesive 25 by which the edge is stuck down to the backing sheet 12. The flap 19 has two lines of perforations 26, 27 extending parallel to and adjacent the strip of adhesive 25 and has two notches 28 providing a lead-in to one end of the lines of perforations 26,27 and forming a tab 29 which can be gripped so that the strip between the two lines of perforations 26,27 can be torn out to provide access to the pamphlet 10. After use, the pamphlet 10 can be covered over by placing the second flap 20 over the first flap 19 and threading the tongue 24 through a slit 30 provided for this purpose in flap 19.

The space on the label not occupied by the cover 11 and pamphlet 10 of course carries the name of the product, its purpose and any other desired matter.

Figure 3:
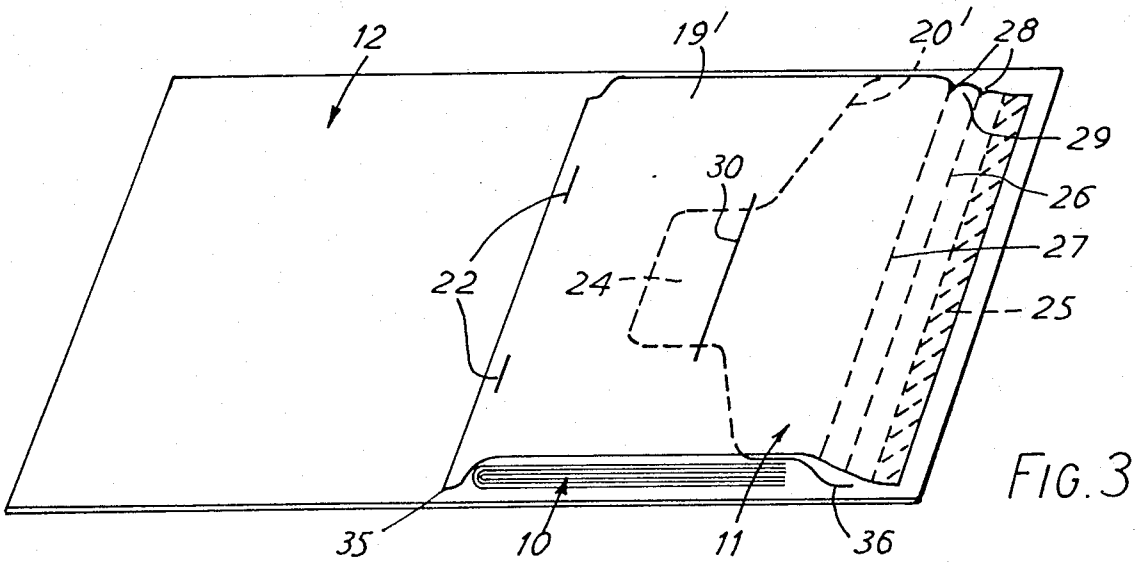
FIG. 3 shows a perspective view of another embodiment of the invention.
Figure 4:
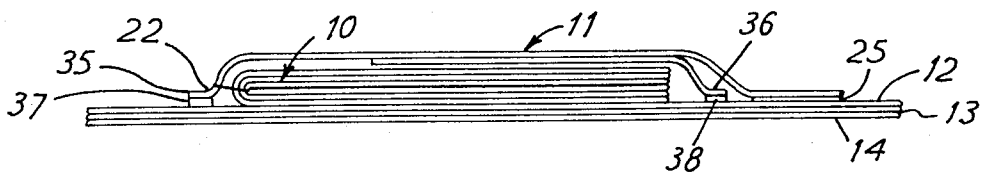
FIG. 4 shows diagrammatically, and not to scale, a local plan view of the right hand end portion of the label shown in FIG. 3.

The reference numerals of the first embodiment have been employed to indicate the same components in FIGS. 3 and 4, which show the second embodiment of the invention.

In the second embodiment, there are provided two separate flaps 19', 20', the ends 35, 36 of which carry respective strips of adhesive 37, 38 and are adhesively secured to the backing sheet 12. The form and operation of the free ends of the flaps 19°, 20' are the same as those of the free ends of the flaps 19, 20 of the first embodiment.

I claim:

1. An adhesive label comprising a sheet having a central portion which has an adhesive on its rear face and first and second flaps connected along fold lines to mutually opposite edges respectively of the central portion and extending towards each other and into overlapping relation, said flaps enclosing a leaflet or pamphlet anchored to said central portion, said first flap being overlapped by said second flap and having a tongue at its free edge, said second flap extending beyond the tongue and having on the rear face of its free edge portion a line of adhesive for fastening said portion down, said second flap also having a line of weakening adjacent said edge portion whereby the main part of the second flap can be separated from said edge portion to provide access to the leaflet or pamphlet, and said main part having a slit therein for receiving the tongue on the first flap to re-enclose the leaflet or pamphlet.

2. A label as claimed in claim 1 wherein a second line of weakening extends parallel to and adjacent the first said line of weakening on the second flap, whereby the strip defined between the two lines of weakening can be removed to provide access to the leaflet or pamphlet.

3. An adhesive label comprising a backing sheet having an adhesive on its rear face, and first and second flaps adhered to the front face of the backing spray which flaps are spaced apart and extend towards each other and into overlapping relation enclosing between the flaps and the backing sheet a leaflet or pamphlet which is anchored with respect to the backing sheet, said first flap being overlapped by the second flap and having a tongue at its free edge, said second flap extending beyond the tongue and having its edge portion adhesively fastened down, and having a line of weakening adjacent said edge portion whereby the main part of said second flap can be separated from said edge portion to enable access to be had to the leaflet or pamphlet, and said main part of the flap having therein a slit for receiving the tongue on the first flap to re-enclose the leaflet or pamphlet.

4. A label as claimed in claim 3 wherein said edge portion of the second flap is adhesively fastened to the backing sheet.

5. A label as claimed in claim 3 wherein the adhesive on the rear face of the backing sheet is a pressure-sensitive adhesive and is covered by a removable protective sheet.

6. A label as claimed in claim 3 wherein the first and second flaps are constituted by extensions at opposite edges of a sheet member the portion of which between the flaps is adhesively secured to the front face of the backing sheet.

* * * * *